US005975141A

United States Patent [19]

Higazy

[11] Patent Number: 5,975,141

[45] Date of Patent: Nov. 2, 1999

[54] ON-LINE VARIABLE ORIFICE

[75] Inventor: Medhat A. Higazy, Troy, Mich.

[73] Assignee: The Detroit Edison Company, Detroit, Mich.

[21] Appl. No.: 09/037,276

[22] Filed: Mar. 9, 1998

[51] Int. Cl.[6] ..... F15D 55/00

[52] U.S. Cl. ..... 138/45; 138/46; 222/547

[58] Field of Search ..... 138/45, 46; 222/547, 222/564

[56] References Cited

U.S. PATENT DOCUMENTS

| | | | |
|---|---|---|---|
| 1,095,767 | 5/1914 | Adams | 138/45 X |
| 1,513,645 | 10/1924 | Smith | 138/45 X |
| 1,893,602 | 1/1933 | Stephens | 138/45 X |
| 2,283,556 | 5/1942 | Karrick | 137/240 |
| 2,791,239 | 5/1957 | Mason | 138/45 |
| 2,810,607 | 10/1957 | Hruby, Jr. | 138/45 X |
| 3,724,503 | 4/1973 | Cooke | 138/45 |
| 3,774,786 | 11/1973 | Cruse | 414/200 |
| 4,092,010 | 5/1978 | Carlson, Jr. | 138/45 X |
| 4,264,213 | 4/1981 | Dillman | 138/39 X |
| 4,390,090 | 6/1983 | Kossebau | 193/32 |
| 4,399,931 | 8/1983 | Maddalena | 222/282 |
| 4,658,992 | 4/1987 | Peleus | 222/547 X |
| 4,899,669 | 2/1990 | Dumbaugh | 110/101 C |
| 4,960,229 | 10/1990 | Dumbaugh | 222/161 |
| 5,046,643 | 9/1991 | Dumbaugh | 222/161 |

*Primary Examiner*—Patrick Brinson
*Attorney, Agent, or Firm*—Reising, Ethington, Barnes, Kisselle, Learman & McCulloch, PC

[57] ABSTRACT

A variable orifice for controlling the flow of pulverized coal and air in a pipe leading to a cool burner comprises a plurality of flow restriction poles extending into the pipe. The poles are radially adjustable to vary the amount of restriction to flow. Indicia are provided to indicate the position of the inner ends of the poles.

10 Claims, 2 Drawing Sheets

ON-LINE VARIABLE ORIFICE

FIELD OF INVENTION

This invention relates generally to variable orifices for controlling fluid flow and more particularly to an on-line variable orifice for controlling the flow of pulverized coal to a coal burner.

BACKGROUND AND SUMMARY OF THE INVENTION

A coal-fired burner in a power plant receives pulverized coal in an air stream through one or more pipes sometimes called "burner lines". Control of the flow in these lines is needed to prevent burner line plugging, unbalanced coal flow, poor combustion in the burner, and excessive emissions. Existing orifices need to be changed from time to time to overcome many of these problems. What is needed is an on-line orifice which is capable of being adjusted to reduce burner line plugging and maintain a more balanced flow of coal, resulting in better combustion in the burner and lower emissions. The orifice should be capable of speedy adjustment without having to shut down the equipment.

In accordance with a specific embodiment of the invention about to be described, pulverized coal in an air stream is delivered to a coal burner by a pipe having a variable orifice comprising a plurality of flow restriction poles which project radially into the pipe. The poles lie in a common plane and are radially adjustable toward and away from each other to vary the amount of restriction to flow. Indicating means are provided to indicate the position of the poles. Preferably, the poles are easily removed when repair or replacement is necessary. Adjustment can be effected without interrupting the flow of coal in the pipe or otherwise shutting down the equipment.

One object of this invention is to provide an on-line variable orifice having the foregoing features and capabilities.

Another object is to provide an on-line variable orifice which is composed of a relatively few simple parts, is rugged and durable in use, is capable of easy adjustment without requiring the equipment to be shut down, and is capable of being inexpensively manufactured and assembled.

These and other objects, features and advantages of the invention will become more apparent as the following description proceeds, especially when considered with the accompanying drawings.

DETAILED DESCRIPTION OF THE PREFERRED EMBODIMENT

Figure 1:
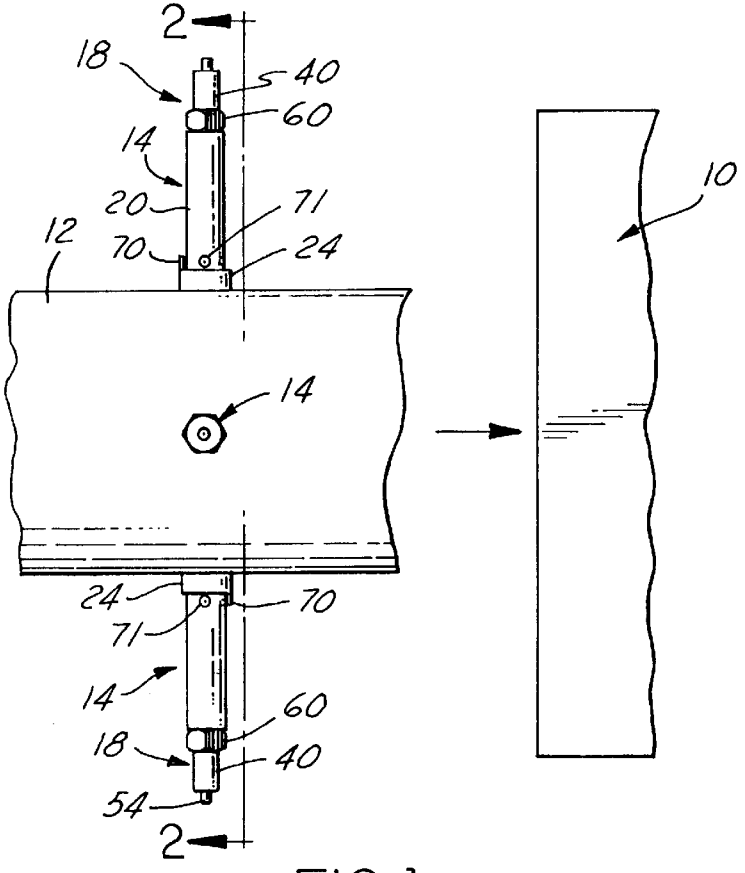
FIG. 1 is a semi-diagrammatic side elevational view of a coal-fired burner and a burner line or pipe leading to the burner, with an on-line variable orifice associated with the pipe and constructed in accordance with the invention.

Referring now more particularly to the drawings, there is shown in FIG. 1, a coal-fired burner 10 and a burner line in the form of a cylindrical pipe 12 for delivering pulverized coal in an air stream to the burner. The size of the coal particles may vary, but usually are about 35–75 microns in diameter. On the pipe 12 are a plurality of flow restrictors 14 which together provide a variable orifice 16 for controlling the flow of the coal-air mixture to the burner. The flow restrictors 14 are all of identical construction and therefore only one needs to be described in detail.

Each flow restrictor 14 comprises an elongated pole 18 which is longitudinally adjustable in an elongated cylindrical tube 20 that projects radially outwardly from the pipe. The inner end 22 of the tube 20 extends through a hole in the cylindrical wall of pipe 12. The tube 20 is threadedly engaged in a base support ring 24 welded or otherwise permanently secured to the outer surface of the pipe. The threaded connection of the tube 20 in ring 24 allows for radial adjustment in the position of the tube so that the inner end of the tube can be made substantially flush with the inner surface of the pipe, as shown. The flow of pulverized coal in the pipe 12 wears or erodes the inner end of the tube 20 so that after a certain period of use it may be necessary to adjust the tube radially inwardly to maintain the flush relationship.

The pole 18 has an inner end portion 28 which extends into the pipe and which comprises an inner rod 30 covered by an outer shell 32 of ceramic or a metal alloy or other hard, wear-resistant material. The shell provides the inner end portion 28 of the pole with a smooth, cylindrical outer surface and a hemispherical inner end or nose 34.

The pole 18 also has an elongated screw 40 provided with an extension 42 of reduced diameter which fits into a socket 44 in the head 46 of rod 30 and is secured thereto by a set screw 48. Hence, the inner end portion 28 of the pole and the screw 40 are rigidly secured together end-to-end. The screw 40 extends within the tube 20 and threadedly engages a bushing 50 disposed in a recess at the inner end of the tube. Rotation of the screw 40 effects radially inward or outward adjustment of the pole. The outer end of the screw has a squared tip portion 54 of reduced cross-section enabling the screw to be turned by a wrench. A lock nut 60 threaded on the screw 40 beyond the outer end of the tube can be threaded down against the outer end of the tube 20 to lock the screw 40, and hence the pole 18, in adjusted position.

The screw 40 is formed with a plurality of transverse cuts or slots 62 equally spaced apart lengthwise thereof. The slots provide indicia for indicating the radial position of the poles. Obviously, as the screw 40 threads radially inwardly to cause a similar movement of the pole, fewer and fewer of the slots will be visible beyond the lock nut 60 at the open outer end of the tube, informing the operator of the position of the nose 34 of the pole.

A marker 70 projecting from the base support ring 24 cooperates with indicia 71 on the tube 20 to provide an indication of the amount that the tube is threaded into the pipe so that if and when erosion causes a wearing away of the inner end of the tube, the tube may be adjusted radially inwardly as needed.

Figure 2:
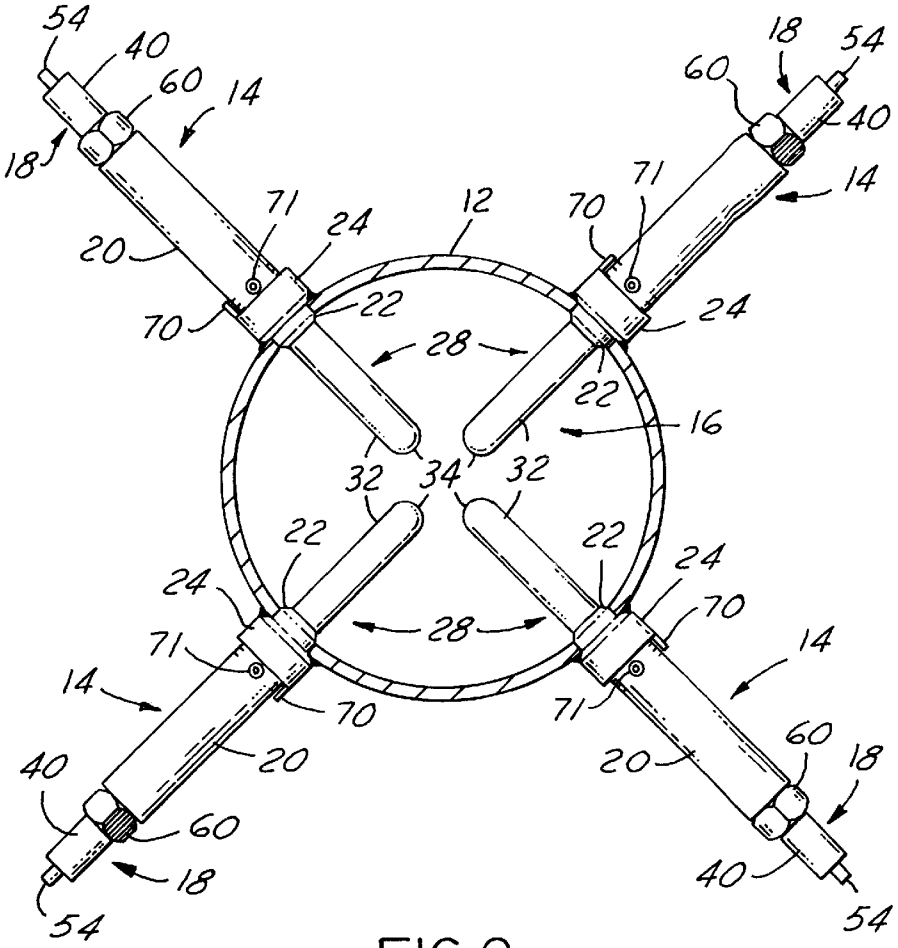
FIG. 2 is a sectional view taken on the line 2—2 in FIG. 1.
Figure 3:
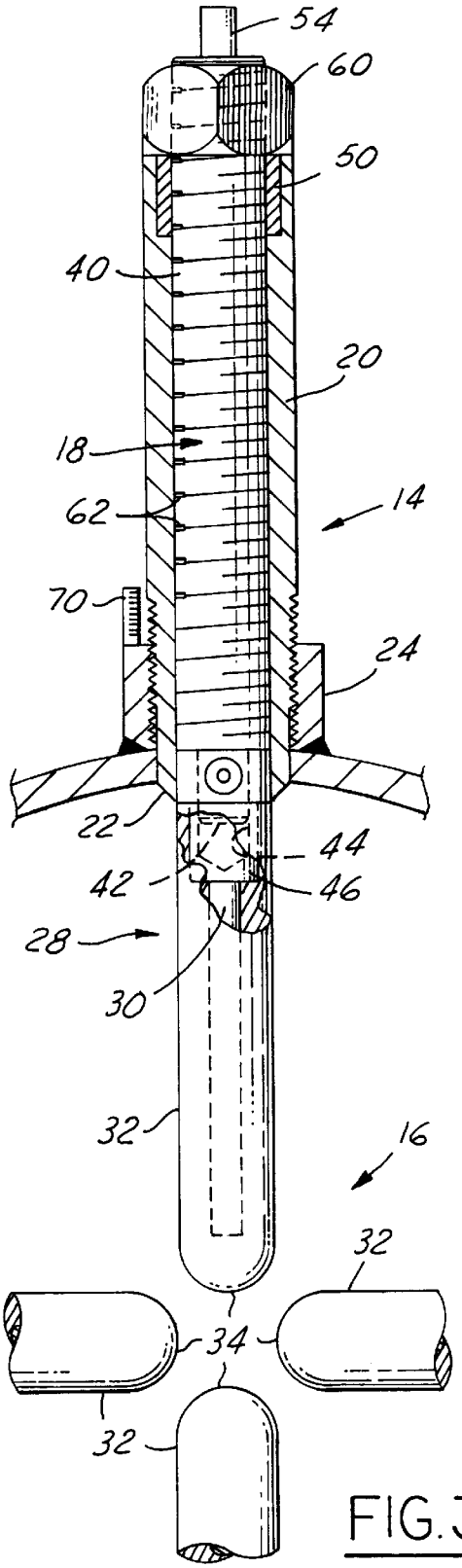
FIG. 3 is an enlarged fragmentary sectional view with parts broken away showing the poles of the variable orifice in extended position.
Figure 4:
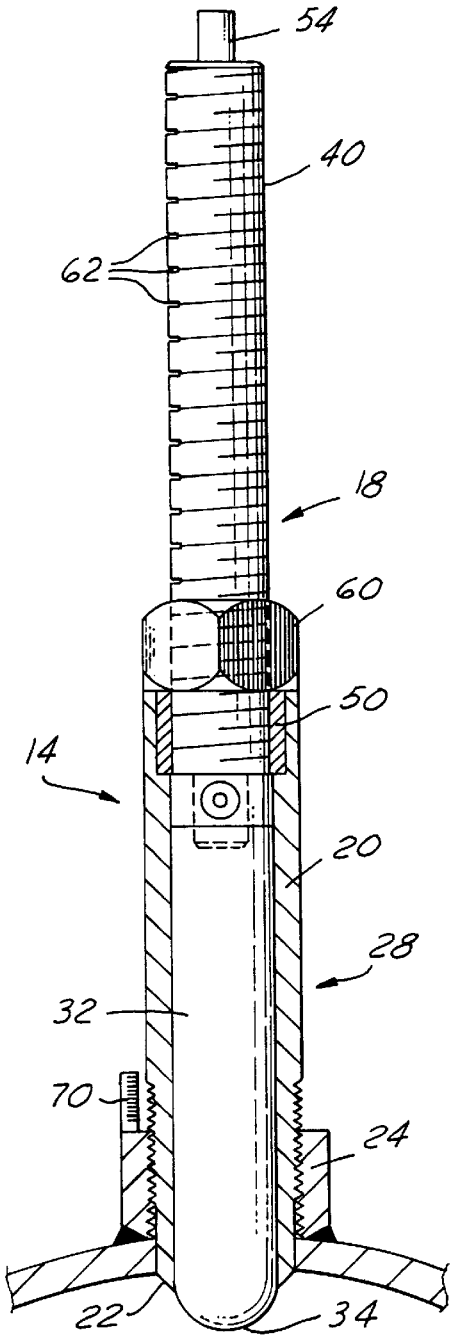
FIG. 4 is a view similar to a portion of FIG. 3 showing one of the poles retracted.

The flow restrictors 14 are disposed in equal angularly spaced relation in a common plane perpendicular to the longitudinal axis of the pipe. The poles 18 may be adjusted radially inwardly to an inner position shown in FIGS. 2 and 3 to increase the restriction to flow of the coal-air mixture, or radially outwardly to the position shown in FIG. 4 to decrease the restriction to flow. This can be done without shutting down the equipment. Although four flow restrictors 14 are shown, the number of flow restrictors may vary, as deemed necessary or desirable. Also, any one or all of the flow restrictors may be removed easily by unscrewing the screw 40 from bushing 50 and then with a straight pull sliding the pole out of the tube 20. This is done whenever it is desired to repair or replace a pole due to wear or erosion or any other reason.

What is claimed is:

1. A variable orifice for controlling the flow of pulverized coal in an air stream in a pipe leading to a coal burner, comprising a plurality of elongated flow restriction poles projecting radially through the pipe into the air stream to restrict the flow of coal, means mounting said poles in the pipe for radial adjustment, and means for radially adjusting said poles to vary the amount of restriction to coal flow.

2. A variable orifice as defined in claim 1, wherein said poles are angularly spaced apart and disposed in a common plane extending transversely of the pipe.

3. A variable orifice as defined in claim 2, wherein said poles have radially inner ends and are radially adjustable by said adjusting means toward and away from a position in which the radially inner ends of said poles are closely adjacent to one another.

4. A variable orifice as defined in claim 3, and further including means for indicating the position of the inner ends of said poles.

5. A variable orifice as defined in claim 1, wherein said poles are equally angularly spaced apart and are disposed in a common plane extending perpendicular to the longitudinal axis of the pipe, and said means mounting said poles for radial adjustment comprises a tube receiving each of said poles.

6. A variable orifice as defined in claim 5, wherein said poles have radially inner ends and are radially adjustable by said adjusting means toward and away from a position in which the radially inner ends of said poles are closely adjacent to one another.

7. A variable orifice as defined in claim 6 and further including means for indicating the position of the inner ends of said poles.

8. A variable orifice as defined in claim 7, wherein said means for radially adjusting said poles comprises a portion of each said pole threadedly engaged with a portion of each tube.

9. A variable orifice as defined in claim 7, wherein each of said tubes is mounted in a hole in said pipe for radial adjustment, and means for indicating the radially adjusted position of said tubes.

10. A variable orifice as defined in claim 9, wherein the inner end of each of said poles includes an inner rod covered by an outer shell of smooth, wear-resistant material.

* * * * *